US006918410B1

(12) United States Patent
Berger

(10) Patent No.: US 6,918,410 B1
(45) Date of Patent: Jul. 19, 2005

(54) METHOD FOR FABRICATING WOVENS

(75) Inventor: Johann Berger, Alfdorf (DE)

(73) Assignee: Berger Seiba-Technotex Verwaltungs GmbH & Co., Bad Sackingen (DE)

( * ) Notice: Subject to any disclaimer, the term of this patent is extended or adjusted under 35 U.S.C. 154(b) by 0 days.

(21) Appl. No.: 10/671,420

(22) Filed: Sep. 25, 2003

Related U.S. Application Data

(63) Continuation of application No. PCT/EP02/03630, filed on Apr. 2, 2002.

(30) Foreign Application Priority Data

Mar. 30, 2001 (DE) ..... 101 15 891

(51) Int. Cl.[7] ..... D03D 39/16

(52) U.S. Cl. ..... 139/21; 139/110; 139/410; 139/414; 139/24; 139/98; 139/403; 139/407

(58) Field of Search ..... 139/109, 103, 139/110, 21, 408, 409, 410, 414, 415, 20, 139/24, 97, 98, 389, 394, 397, 398, 402, 139/403, 407

(56) References Cited

U.S. PATENT DOCUMENTS

| | | | | |
|---|---|---|---|---|
| 1,582,415 | A * | 4/1926 | Manley | 139/415 |
| 2,171,367 | A * | 8/1939 | Kaufman | 139/21 |
| 2,285,793 | A * | 6/1942 | Baker | 139/21 |
| 2,502,101 | A * | 3/1950 | Morgan et al. | 139/384 R |
| 2,785,705 | A | 3/1957 | Neisler, Jr. | |
| 3,426,806 | A * | 2/1969 | Pfarrwaller | 139/101 |
| 4,662,407 | A * | 5/1987 | Duncan | 139/103 |
| 4,815,500 | A * | 3/1989 | Goineau | 139/21 |
| 4,949,759 | A * | 8/1990 | Takegawa et al. | 139/25 |
| 4,989,647 | A | 2/1991 | Marchand | |
| 5,259,421 | A * | 11/1993 | Alexander et al. | 139/110 |
| 5,261,465 | A * | 11/1993 | Dore | 139/103 |
| 5,568,826 | A | 10/1996 | Vogel et al. | |
| 5,592,977 | A * | 1/1997 | Kikuchi et al. | 139/387 R |
| 6,098,670 | A | 8/2000 | Baumann | |

FOREIGN PATENT DOCUMENTS

| | | |
|---|---|---|
| BE | 1010848 | 2/1999 |
| DE | 3813740 | 1/1989 |
| DE | 4226954 | 2/1994 |
| DE | 19927127 | 12/2000 |
| GB | 151208 | 9/1920 |

OTHER PUBLICATIONS

International Search Report PCT/EP02/03630, Nov. 15, 2002, 3 pages.
International Publication WO 02/079554, Oct. 10, 2002, for PCT/EP02/03630 with English translation.

* cited by examiner

*Primary Examiner*—John J. Calvert
*Assistant Examiner*—Robert H. Muromoto, Jr.
(74) *Attorney, Agent, or Firm*—Harness, Dickey & Pierce, P.L.C.

(57) ABSTRACT

A method for weaving single-layered and/or multi-layered woven fabric, especially airbag fabric, includes interweaving warp threads delivered by at least two warp beams.

13 Claims, 1 Drawing Sheet

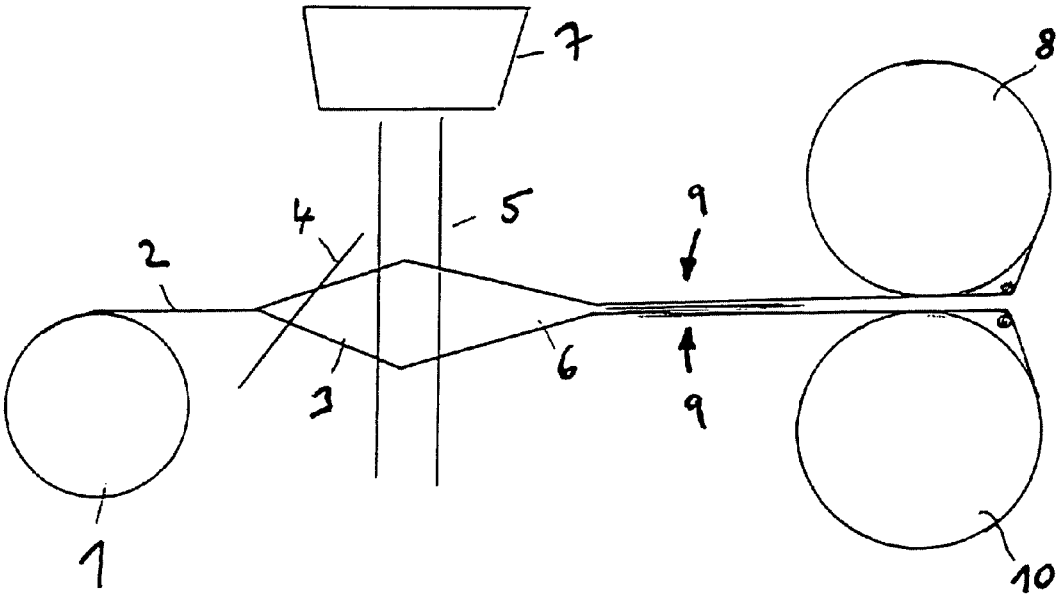
7
8
4
5
9
2
3
6
9
1
10

METHOD FOR FABRICATING WOVENS

CROSS-REFERENCE TO RELATED APPLICATIONS

This application is a continuation of PCT/EP02/03630, filed Apr. 2, 2002 which claims priority to DE 101 15 891.2, filed Mar. 30, 2001, both of which are incorporated by reference herein.

BACKGROUND AND SUMMARY OF THE INVENTION

The invention relates to a method for weaving fabrics, more particularly air bag fabrics.

In conventional fabric weaving techniques loose warp threads materialize from differences in having worked them in, following a change in weave. These loose threads are a disadvantage as to permeability of the fabric and its visual appeal. Known, in addition, are techniques for weaving two-ply fabrics from a warp band furnished by just a single warp beam in which due to the shed geometry differences in tension may materialize between the upper and lower fabric. These are of a disadvantage in that they prompt differences in the physical properties between the lower and upper fabric. These differences between the lower and upper fabric become an exceptionally critical factor in fabricating wovens, especially where air bags are concerned, in other words safety items, requiring maximum assurance in reliable physical response within such air bags. This is especially the case when the fabric is put to use uncoated. It is in the uncoated portion, namely, that uniform physical properties in the various plies of the fabric is of utmost importance, since it is here that defined air permeabilities substantially influence functioning of an air bag by their uniformity.

Apart from this, conventional techniques are also deficient for further reasons. For instance, collecting the warp thread band on the beam results in disadvantages in warp production, since in sizing, because of the high thread assignment on the beam there is no assurance of each and every thread being fully sized. The warp thread is sized to make it more resistant in the weaving process. Thus, lack of complete sizing results in enormous losses in quality because of the resulting faults such as capillary breaks, fluff nesting, thread breakage. These faults can be avoided by adequate, uniform sizing. It may happen in sizing that because of the high thread assignment per beam, several threads may tack together over a lengthy warp distance, this too resulting in the cited losses in quality in later weaving.

In the so-called back shed of the weaving machine the set is very high especially when fabrics having two or more plies are woven on just a single beam. Here too, because of the cramped space in the back shed the cited losses in weave and quality may arise despite sizing being theoretically an optimum.

The invention is based on the object of proposing a method for weaving fabrics, more particularly air bag fabrics which avoids or at least greatly diminishes the disadvantage known from prior art.

This object is achieved by a method as it reads from claim 1. Distributing warp thread band required as a whole for a fabric on at least two warp beams, permits making use of warp thread material sized substantially better than in conventional techniques. Now, in fabricating the warp to be implemented prior to the method in accordance with the invention the individual threads can also be totally sized for a double warp spacing because of the reduced set per beam as a whole. It is because of this reduced set per beam as a whole as made possible by the method in accordance with the invention that the risk of warp threads sticking to each other is minimized in thus practically eliminating both tack and nesting of the warp threads (broken capillaries due to inadequate sizing) drastically reducing rejects in weaving.

In addition to this, the method in accordance with the invention has further advantages, especially when, where multi-ply, for example two-ply fabrics are involved, each ply can be produced separately with a warp thread band of its own beam. This now makes it possible to equalize the tension over the full width of the fabric, comparable to that of single-ply fabrics in usual fabrication on the market. In other words, the method in accordance with the invention now makes it possible to attain the necessary very high woven quality in achieving practically the same technical properties in each ply. Apart from this, the technique as described in accordance with the invention minimizes differences in tension when a change is made from a single-ply P3/3 portion to a two-ply weave.

In one advantageous aspect of the method in accordance with the invention each warp beam is controlled for tension independently of the other, further enhancing uniformity of the fabric especially where two-ply wovens are concerned.

In another advantageous aspect of the method in accordance with the invention the warp beams receive differing warp thread materials. If such a fabric is intended, for example, for an automotive side air bag, the ply of the fabric facing the vehicle occupant (when fitted in the vehicle) can be selected to achieve a surface of the air bag which is gentle to the head of the vehicle occupant, whereas the other fabric ply facing the window may comprise a warp thread material which is particularly resistant to shattered glass or the like. This aspect of the invention now makes it possible to employ warp threads differing in quality and price status for the two plies. Thus, materials of a higher quality or particularly expedient (for instance by being finer) may be selected for the "head side", whilst rough, cheaper materials can be put to use for the "window side". This also makes for better cost-effectiveness in production. Depending on the particular requirements warp threads differing in strength, texture, elasticity, fineness or material finish can be selected for the two or more plies of warp threads. Just as conceivable is the use of elastic warp threads on one beam and non-elastic warp threads on the other beam. This approach offers a wealth of advantages.

BRIEF DESCRIPTION OF THE DRAWINGS

The present invention will become more fully understood from the detailed description and the accompanying drawing, wherein:

FIG. 1 is a diagrammatic side view of a weaving system according to the principles of the present invention.

DETAILED DESCRIPTION

The method in accordance with the invention will now be detailed by way of example with reference to the drawing.

Referring now to the sole FIGURE of the drawing there is illustrated diagrammatically an arrangement of a weaving machine as viewed from the side. The warp beams 8 and 10 furnish bands 9 of warp threads to the weaving location. In the region of a harness packet 5 of a Jacquard machine 7 (indicated stylized) the reciprocating motion of the individual warp threads forms the back shed 6 and weave shed 3. In the region of the left-hand end of the shed 3 the reed 4 is evident, from which a single- and/or multi-ply fabric 2 is reeled by a product takeup reel 1.

Making use of two or more warp beams in accordance with the invention in interweaving single- and/or multi-ply fabrics also makes for a substantial cost advantage, since the frequency and time needed in changing the warp is reduced by the application of a plurality of warp beams.

What is claimed is:

1. A method for weaving airbag fabrics comprising partly single-ply portions and partly two-ply portions, said two-ply portions including a first ply and a second ply, the method comprising:

(a) interweaving warp threads furnished by a least two warp beams;

(b) producing the first ply with a warp thread band of an assigned first of said warp beams;

(c) producing the second ply with a warp thread band of an assigned second of said warp beams; and (d) controlling the at least two warp beams for tension, each independently of the other.

2. The method as set forth in claim 1, wherein said warp beams receive differing warp thread materials.

3. The method as set forth in claim 1, further comprising implementing the method on a weaving machine fitted with a Jacquard machine.

4. A method for weaving fabrics on a weaving machine including a Jacquard machine, the method comprising:

(a) interweaving warp threads;

(b) creating an upper ply separately with a warp thread band of a first assigned warp beam;

(c) creating a lower ply separately with a warp thread band of a second assigned warp beam; and (d) independently controlling tension of the warp beams.

5. A method for weaving fabric, said method comprising:

interweaving a warp thread from a first warp beam with a warp thread from a second warp beam;

producing an upper ply solely from said first warp beam;

producing an lower ply solely from said second warp beam; and creating a lower ply separately with a warp thread band of a second assigned warp beam; and controlling a tension in said first wrap beam separately from said second warp beam.

6. The method according to claim 5 wherein said interweaving a warp thread from said first warp beam with a warp thread from said second warp beam includes interweaving a warp thread made of a first material from said fist warp beam with a warp thread made of a second material from said second warp beam, wherein said first material is different from said second material.

7. The method according to claim 5, further comprising:

implementing said method on a weaving machine fitted with a Jacquard machine.

8. A method for weaving fabric on a weaving machine, the method comprising:

(a) interweaving warp threads delivered separately from at least two warp beams;

(b) producing an upper ply solely from a first of said warp beams and a lower ply solely from a second of said warp beams; and (c) independently controlling tension of said warp beams.

9. The method according to claim 8 wherein said fabric is an automotive airbag fabric.

10. The method according to claim 8 wherein said weaving machine is a Jacquard machine.

11. The method according to claim 8 further comprising equaling tension over the full width of said fabric.

12. The method according to claim 8 wherein said warp threads of one of said beams are of a different material than that of the other of said beams.

13. The method according to claim 5 wherein said fabric is an automotive airbag fabric.

* * * * *